US010285506B2

(12) United States Patent
Choi

(10) Patent No.: US 10,285,506 B2
(45) Date of Patent: May 14, 2019

(54) FOLDABLE BED FRAME HAVING PIVOTALLY CONNECTED FRAME UNITS

(71) Applicant: Inno-Sports Co., Ltd., Xiamen (CN)

(72) Inventor: Kwanjun Choi, Xiamen (CN)

(73) Assignee: Inno-Sports Co., Ltd., Xiamen (CN)

( * ) Notice: Subject to any disclaimer, the term of this patent is extended or adjusted under 35 U.S.C. 154(b) by 601 days.

(21) Appl. No.: 15/144,471

(22) Filed: May 2, 2016

(65) Prior Publication Data

US 2016/0316921 A1 Nov. 3, 2016

(30) Foreign Application Priority Data

| | | |
|---|---|---|
| Apr. 30, 2015 | (CN) | 2015 2 0274106 U |
| Apr. 30, 2015 | (CN) | 2015 2 0274178 U |
| May 21, 2015 | (CN) | 2015 2 0330822 U |
| May 21, 2015 | (CN) | 2015 2 0331222 U |

(51) Int. Cl.

| | |
|---|---|
| ***A47C 19/12*** | (2006.01) |
| ***A47C 19/02*** | (2006.01) |
| *A47C 17/68* | (2006.01) |
| *A47C 17/70* | (2006.01) |

(52) U.S. Cl.

CPC ..... *A47C 19/122* (2013.01); *A47C 19/024* (2013.01); *A47C 19/025* (2013.01); *A47C 19/128* (2013.01); *A47C 17/68* (2013.01); *A47C 17/70* (2013.01)

(58) Field of Classification Search

CPC ..... A47C 19/12; A47C 19/122; A47C 19/128; A47C 17/68; A47C 17/70; A47C 17/74

See application file for complete search history.

(56) References Cited

U.S. PATENT DOCUMENTS

| | | | | | |
|---|---|---|---|---|---|
| 605,126 | A * | 6/1898 | Odell | A47C 19/122 | 5/152 |
| 1,070,525 | A * | 8/1913 | Pieper | F16M 11/04 | 248/281.11 |
| 1,196,253 | A * | 8/1916 | Lowy | A47C 19/122 | 5/154 |
| 1,259,825 | A * | 3/1918 | Basile | A47C 17/68 | 5/180 |
| 1,360,983 | A * | 11/1920 | Burton | A47C 19/122 | 5/154 |

(Continued)

OTHER PUBLICATIONS

U.S. Appl. No. 15/144,575, filed May 2, 2016.

(Continued)

*Primary Examiner* — Peter M. Cuomo
*Assistant Examiner* — Ifeolu A Adeboyejo
(74) *Attorney, Agent, or Firm* — Morgan, Lewis & Bockius LLP

(57) ABSTRACT

A foldable bed frame includes frame units pivotally connected to each other by one or more connecting assemblies. A frame unit includes upper and lower frames, legs or links connected to the upper and lower frames, and limiting pieces disposed on the upper and lower frames to limit rotation angles or directions of the legs or links. A connecting assembly includes middle leg(s) or middle bar(s), and connecting pieces. When folded, the bed frame is compact. When unfolded, the bed frame provides storage spaces underneath, and facilitates positioning and holding of bed shirts/sheets.

12 Claims, 14 Drawing Sheets

(56) References Cited

U.S. PATENT DOCUMENTS 1,530,726 A * 3/1925 Koenigkramer ..... A47B 3/0918 108/35
1,574,659 A * 2/1926 Johnston ..... A47C 19/122 5/114
2,513,168 A * 6/1950 Gottlieb ..... A47C 19/122 5/111
2,651,787 A * 9/1953 Piliero ..... A47C 19/122 5/152
2,671,229 A * 3/1954 Vernier ..... A47C 17/68 482/28
2,678,085 A * 5/1954 De Minno ..... A47C 20/043 297/383
2,701,603 A 2/1955 Coopersmith
2,782,075 A * 2/1957 Fagan ..... E04G 1/34 108/167
2,888,688 A * 6/1959 Bereman ..... A47C 17/68 5/111
3,245,363 A * 4/1966 Kanitz ..... A47B 3/087 108/168
3,295,149 A * 1/1967 Hall ..... A47C 19/122 5/111
4,048,683 A * 9/1977 Chen ..... A47C 19/122 5/174
4,620,336 A * 11/1986 Miller ..... A47C 23/005 5/249
4,654,905 A * 4/1987 Miller ..... A47C 23/005 5/249
5,894,614 A * 4/1999 Stroud ..... A47B 91/028 5/200.1
6,151,730 A 11/2000 Weston
7,376,989 B2 * 5/2008 Wickstrom ..... A47C 17/225 5/250
7,406,727 B2 * 8/2008 Wickstrom ..... A47C 23/005 5/12.2
7,503,086 B2 * 3/2009 Wickstrom ..... A47C 17/225 5/174
8,312,576 B1 * 11/2012 Oh ..... A47C 23/005 5/174
8,370,973 B1 * 2/2013 Oh ..... A47C 19/122 5/174
8,769,740 B2 * 7/2014 Oh ..... A47C 19/12 5/174
8,898,832 B2 * 12/2014 Oh ..... A47C 19/12 5/174
9,226,590 B1 * 1/2016 Hull ..... F16B 12/56
9,314,386 B1 4/2016 Boyd
9,456,699 B1 * 10/2016 Oh ..... A47C 19/122
9,526,347 B2 * 12/2016 Boyd ..... A47C 19/04
9,538,850 B2 * 1/2017 Oh ..... A47C 19/02
9,907,405 B2 * 3/2018 An ..... A47C 19/122
10,034,551 B2 * 7/2018 Hull ..... A47C 19/12
10,123,629 B2 * 11/2018 Choi ..... A47C 19/122
2005/0251911 A1 * 11/2005 Wickstrom ..... A47C 23/005 5/247
2006/0195982 A1 * 9/2006 Cloer ..... A47C 19/024 5/202
2006/0230532 A1 * 10/2006 Wickstrom ..... A47C 17/225 5/250
2008/0000024 A1 * 1/2008 Peixin ..... A47C 19/04 5/112
2009/0293193 A1 * 12/2009 Neatherry ..... A47C 23/005 5/1
2011/0073723 A1 3/2011 Ashpole
2011/0099712 A1 * 5/2011 Jin ..... A47C 19/122 5/174
2012/0042449 A1 * 2/2012 Hull ..... A47C 23/005 5/246
2012/0222216 A1 * 9/2012 Jin ..... A47C 19/028 5/400
2013/0067659 A1 * 3/2013 Oh ..... A47C 19/12 5/400
2013/0067862 A1 3/2013 Oh
2014/0345044 A1 11/2014 Murphy
2015/0320225 A1 * 11/2015 Boyd ..... A47C 19/04 5/202
2016/0302582 A1 * 10/2016 Oh ..... A47C 19/02
2017/0119166 A1 5/2017 An
2018/0116412 A1 * 5/2018 Jin ..... A47C 19/025

OTHER PUBLICATIONS

U.S. Appl. No. 15/056,150, filed Feb. 29, 2016.
U.S. Appl. No. 15/820,754, filed Nov. 22, 2017.
U.S. Appl. No. 15/820,848, filed Nov. 22, 2017.
U.S. Appl. No. 15/423,251, filed Feb. 2, 2017.
U.S. Appl. No. 15/640,810, filed Jul. 3, 2017.
U.S. Appl. No. 15/663,522, filed Jul. 28, 2017.
U.S. Appl. No. 15/809,161, filed Nov. 10, 2017.

* cited by examiner

FOLDABLE BED FRAME HAVING PIVOTALLY CONNECTED FRAME UNITS

CROSS-REFERENCE TO RELATED APPLICATIONS

The present application claims priority of Chinese Utility Model Applications CN 201520274106.0 filed on Apr. 30, 2015, CN 201520274178.5 filed on Apr. 30, 2015, CN 201520331222.1 filed on May 21, 2015, and CN 201520330822.6 filed on May 21, 2015, the entire contents of which application are incorporated herein for all purposes by this reference.

FIELD OF THE INVENTION

The present invention generally relates to foldable bed frames. More particularly, the present invention relates to foldable bed frames having pivotally connected frame units, each with upper and lower frames connected and supported by legs, links or the like.

BACKGROUND

Many household goods are required to have multiple and adjustable functions to meet the demands of modern life. Among them are metal foldable bed frames to accommodate limited living spaces.

One conventional metal foldable bed frame includes a top frame made of two sub-frames. The bed frame also includes supporting legs pivotally connected to the top frame, and a middle leg disposed between and pivotally connected to the two sub-frames. Usually, the middle leg is connected to middle portions of longitudinal bars of the top frame. When folded, the middle leg extends beyond the top frame, resulting in the folded bed frame with a dimension (e.g., height or thickness) roughly equal to the sum of the dimensions of the folded top frame and the middle leg. The size of the bed frame when folded is thus not minimized, and consequently, it is impossible to maximize the shipping capacity (e.g., container package density) and difficult to reduce shipping cost.

As the top frame is supported by the legs, there are free spaces underneath the top frame. To improve the comfort and aesthetic appearance of the bed frame, a bed skirt/sheet is usually placed over the top frame and draped down close to the ground/floor to cover the bed frame and the space underneath. However, the bed frame cannot hold the bed skirt/sheet in position. The bed skirt/sheet slides easily, drawn to the ground and sometimes even fallen to the ground, and thus deteriorating the overall appearance. To keep it neat and orderly, users often need to pull and adjust the skirt/sheet repeatedly. In addition, the draped bed skirt/sheet close to the ground/floor is inconvenient for cleaning the ground/floor.

Another conventional foldable metal bed frame includes an upper frame and a lower frame. Each of the upper and lower frames separately includes a left sub-frame and a right sub-frame. The upper and lower frames are connected by supporting bars. There is no leg in this foldable metal bed frame. When in use, the bed frame is directly placed on the ground/floor. As such, the height of the resulting bed is relatively low and there is no space underneath to serve as storage spaces. In addition, it is inconvenient for cleaning the ground/floor underneath the bed.

Given the current state of the art, there remains a need in the art for a foldable bed frame that addresses the above-mentioned issues.

The information disclosed in this Background section is provided for an understanding of the general background of the invention and is not an acknowledgement or suggestion that this information forms part of the prior art already known to a person skilled in the art.

SUMMARY

Various embodiments of the present invention provide foldable bed frames that are compact when folded. When unfolded, the foldable bed frames provide storage spaces, have aesthetic appearance, hold bed skirts/sheets, and are convenient for cleaning the ground/floor underneath.

In some embodiments, the present invention provides a foldable bed frame including a first frame unit and a second frame unit pivotally connected to each other at proximal sides. Each frame unit includes an upper frame, a lower frame, a plurality of vertical links and a plurality of limiting pieces. The lower frame is disposed below the upper frame when the foldable bed frame is unfolded. The plurality of vertical links includes first and second vertical links disposed on left and right sides of the frame unit, and at or adjacent to the proximal side of the frame unit. Each of the first and second vertical links is pivotally connected to the upper and lower frames. The plurality of limiting pieces is disposed on the upper frame and the lower frame to limit rotation angles or directions of the vertical links. The foldable bed frame also includes a connecting assembly disposed between the first and second frame units and pivotally connected to the first frame unit and the second frame unit. The connecting assembly includes a middle leg assembly and a plurality of connecting pieces. The middle leg assembly includes a top lateral bar, first and second middle legs, and first and second pivotal links. The top lateral bar has first and second ends. First and second middle legs are coupled to the first and second ends of the top lateral bar at a lower side of the top lateral bar. Each middle leg includes an inner tube and an outer tube slidably coupled to each other. First and second pivotal links are coupled to the first and second ends of the top lateral bar and pivotally connected to the upper frames of the first and second frame units. Each connecting piece has one end pivotally connected to the first or second middle leg, and the other end pivotally connected to the lower frame of the first or second frame unit at a location where a corresponding vertical link is connected to the lower frame.

In some embodiments, each of the first and second frame units further includes first and second side legs disposed on the left and right sides of the first or second frame unit, and at or adjacent to a distal side of the first or second frame unit. Each of the first and second side legs is pivotally connected to the upper and lower frames of the first or second frame unit. Corresponding to the first and second side legs, the plurality of limiting pieces includes limiting pieces disposed on the upper and lower frames to limit rotation angles or directions of the side legs. In some embodiments, each of the first and second frame units further includes a lateral bar disposed between the first and second side legs and connecting the first side leg with the second side leg.

In some embodiments, for each of the first and second frame units, the plurality of vertical links further includes third and fourth vertical links disposed on the left and right sides of the first or second frame unit, and at or adjacent to a distal side of the first or second frame unit.

In some embodiments, the first frame unit is substantially symmetric to the second frame unit.

In some embodiments, for each of the first and second middle legs, the middle leg assembly further includes a seat or a connector or both. The seat is disposed at an upper end of the outer tube, and includes a sleeve coupled to the upper end of the outer tube and a clamping slot formed above the sleeve and corresponding to the top lateral bar. In an embodiment, the sleeve is formed with U-shaped grooves on opposite side walls. The connector is coupled to the top lateral bar, and connects the inner tube with the top lateral bar. In some embodiments, the lower side of the top lateral bar is formed with a slot adjacent to each of the first and second ends of the top lateral bar to receive the connector. The connector includes a shaft inserted into the inner tube of the middle leg and fasteners to affix the connector with the top lateral bar and affix the inner tube with the connector.

In some embodiments, the inner and outer tubes of each middle leg are slidably coupled to each other by a sliding slot formed on the inner tube along a longitudinal direction of the inner tube, and a pin disposed at an upper end of the outer tube and extended through the sliding slot of the inner tube. In some embodiments, the seat, the inner tube and the outer tube are coupled to each other by the sliding slot and the pin extending through the sliding slot of the inner tube and the sleeve of the seat.

In some embodiments, for each of the first and second middle legs, the lower side of the top lateral bar is provided or formed with a pivotal piece at each of the first and second ends of the top lateral bar, and an upper end of the inner tube is provided or formed with a pair of pivotal pieces. The pivotal piece of the top lateral bar is disposed between the pair of pivotal pieces of the inner tube and connected the pair of pivotal pieces of the inner tube.

In some embodiments, the middle leg assembly further includes a middle lateral bar connecting the first and second middle legs.

In some embodiments, one end of each connecting piece is pivotally connected to the outer tube of the first or second middle leg.

In some embodiments, the foldable bed frame further includes first and second elastic members connecting the corresponding proximal sides of the lower frames of the first and second frame units.

In some embodiments, the present invention provides a foldable bed frame including a first frame unit and a second frame unit pivotally connected to each other at their proximal sides. Each frame unit includes an upper frame, a lower frame, a plurality of side legs and a plurality of limiting pieces. The upper frame includes first and second upper longitudinal bars, and first and second upper lateral bars disposed between the first and second upper longitudinal bars. The lower frame is disposed below the upper frame when the foldable bed frame is unfolded. The lower frame includes first and second lower longitudinal bars, and first and second lower lateral bars disposed between the first and second lower longitudinal bars. Each side leg has a top end pivotally connected to an inner side of the first or second upper longitudinal bar, and a middle portion pivotally connected to the corresponding first or second lower longitudinal bar. The plurality of limiting pieces is disposed on lower sides of the first and second upper longitudinal bars and on upper sides of the first and second lower longitudinal bars to limit rotation angles or directions of the plurality of side legs. The bed frame also includes a first connecting assembly and a second connecting assembly disposed on left and right sides of the foldable bed frame and between the first and second frame units. Each of the first and second connecting assemblies includes a middle leg or a middle bar, an upper connecting piece, and a lower connecting piece. The upper connecting piece is disposed on the middle leg or the middle bar, and pivotally connected to the upper longitudinal bars of the first and second frame units. The lower connecting piece is disposed on the middle leg or the middle bar, and pivotally connected to the lower longitudinal bars of the first and second frame units. In a preferred embodiment, the upper connecting piece is longer than the lower connecting piece.

In some embodiments, each of the first and second connecting assemblies further includes an upper stopping piece or a lower stopping piece or both. The upper stopping piece is disposed or formed at a lower side of the upper connecting piece below the upper longitudinal bars of the first and second frame units. The upper stopping piece has a length shorter than a distance between pivotal points at which the upper longitudinal bars are connected to the upper connecting piece. The lower stopping piece are disposed or formed at an upper side of the lower connecting piece above the lower longitudinal bars of the first and second frame units. The lower stopping piece has a length shorter than a distance between pivotal points at which the lower longitudinal bars are connected to the lower connecting piece.

In some embodiments, the upper frame of the first or second frame unit further includes one or more upper longitudinal bars, one or more upper lateral bars, or both. The one or more upper longitudinal bars are disposed between the first and second upper longitudinal bars, and connected to the first and second upper lateral bars. The one or more upper lateral bars are disposed between the first and second upper lateral bars and connected to the first and second upper longitudinal bars. In some embodiments, the one or more upper longitudinal bars and the one or more upper lateral bars crisscross each other.

In some embodiments, for each frame unit, the plurality of side legs includes first and second side legs. The first side leg is disposed on a left side of the frame unit, and the second side leg is disposed on a right side of the frame unit. For each of first and second connecting assemblies, the upper connecting piece is disposed at a top end of the middle leg and the lower connecting piece is disposed at a middle portion of the middle leg.

In some embodiments, for each frame unit, the plurality of side legs includes first, second, third and fourth side legs. The first and third side legs are disposed on a left side of the frame unit, and the second and fourth side legs are disposed on a right side of the frame unit. For each of first and second connecting assemblies, the upper connecting piece is disposed at a top end of the middle bar and the lower connecting piece is disposed at a lower end of the middle bar. The middle bar, the upper connecting piece and the middle connecting piece collectively form a substantially "工" shaped structure.

The foldable bed frames of the present invention have other features and advantages that will be apparent from or are set forth in more detail in the accompanying drawings, which are incorporated herein, and the following Detailed Description, which together serve to explain certain principles of the present invention.

BRIEF DESCRIPTION OF THE DRAWINGS

The accompanying drawings, which are incorporated into and constitute a part of this specification, illustrate one or more embodiments of the present application and, together with the detailed description, serve to explain the principles and implementations of the application.

DETAILED DESCRIPTION

Figure 1:
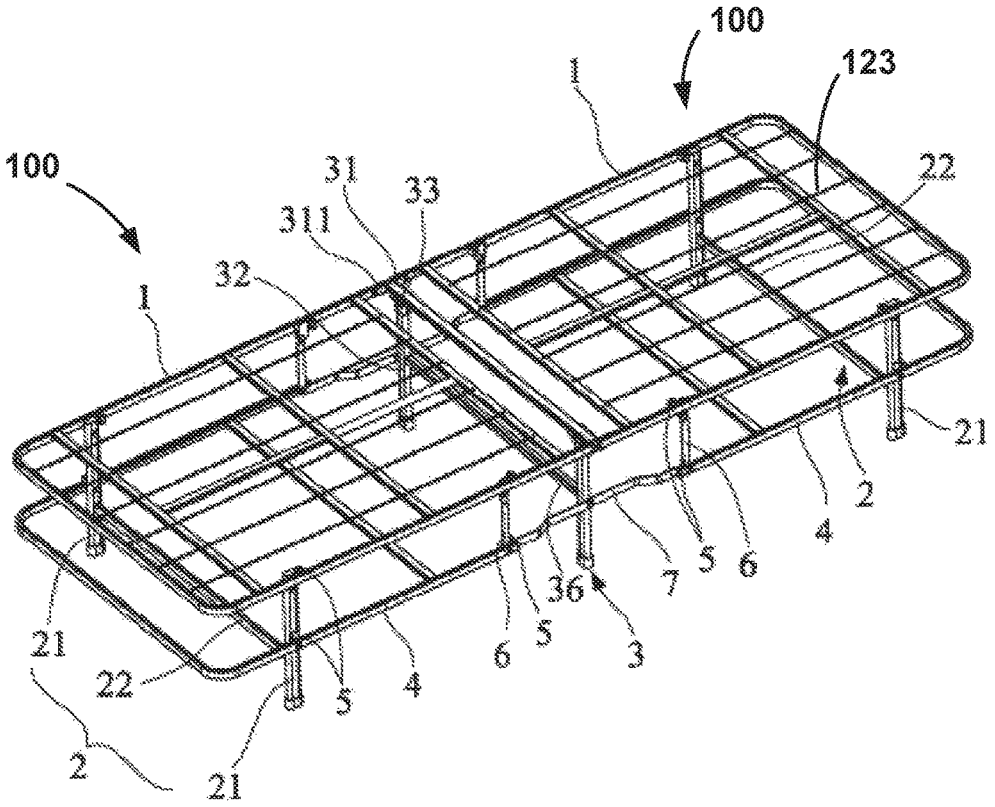
FIG. 1 is a schematic perspective view illustrating a first exemplary foldable bed frame in an unfolded state in accordance with some embodiments of the present invention.

Reference will now be made in detail to implementations of the exemplary embodiments of the present invention as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present invention will readily suggest themselves to such skilled persons having benefit of this disclosure.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the embodiments set forth in this disclosure can be made without departing from their spirit and scope, as will be apparent to those skilled in the art. The specific embodiments described herein are offered by way of example only, and the disclosure is to be limited only by the terms of the appended claims, along with the full scope of equivalents to which such claims are entitled.

Embodiments of the present invention are described in the context of bed frames. The bed frames can be of various sizes including but not limited to twin, full, queen and king sizes, and of various shapes including but not limited to rectangles and squares. Also, the bed frames can be made of various materials including but not limited to metals such as steel, plastics and woods. In most cases, the bed frames of the present invention can be used alone by placing them on a floor or a ground. In some cases, the bed frames of the present invention are configured to have structures similar to supporting frames. In such cases, the bed frames of the present invention can be placed on other bed frames, and thus increase the heights of the beds to accommodate users' different heights or preferences.

Generally, a bed frame of the present invention includes a plurality of frame units and one or more connecting assemblies pivotally connecting the plurality of frame units to each other. A frame unit includes an upper frame and a lower frame. A frame unit also includes vertical links or side legs, and in some cases, includes both vertical links and side legs. The vertical links and/or the side legs are pivotally connected to the upper and lower frames, and support the upper and lower frames when the bed frame is unfolded. A connecting assembly typically includes middle leg(s), and in some cases includes middle bar(s), pivotally connected to upper and lower frames through connecting piece(s). In some cases, the length of the middle legs is adjustable.

Referring now to FIGS. 1-6, there depicts a first exemplary foldable bed frame in accordance with some embodiments of the present invention. As shown, the first exemplary foldable bed frame includes a plurality of frame units such as first and second frame units 100, and a connecting assembly disposed between and pivotally connected to the first and second frame units 100. The connecting assembly includes a middle leg assembly such as middle leg assembly 3, and a plurality of connecting pieces such as connecting pieces 7. First and second frame units 100 are pivotally connected to each other through middle leg assembly 3 and connecting pieces 7. As used herein, the sides at which first and second frame units 100 are connected to each other are referred to as their proximal sides, and the sides opposite to the proximal sides are referred to as their distal sides. For instance, in FIG. 1, the proximal sides of first and second frame units are in the middle of the bed frame. The distal sides correspond to head and foot sections of the bed frame. The other two sides are referred to as left and right sides. It should be noted that the term "middle" as used herein does not necessarily mean the center of the bed frame, and the term "side" does not necessarily mean an outmost edge of the bed frame.

Each of the first and second frame units includes upper frame 1, lower frame 4, a plurality of vertical links 6 and a plurality of limiting pieces 5. When the foldable bed frame is unfolded, lower frame 4 is disposed below upper frame 1. In some embodiments, for each of the first and second frame units, the plurality of vertical links 6 includes first and second vertical links disposed at or adjacent to the proximal side of the frame unit, with the first vertical link disposed on the left side of the frame unit and the second vertical link disposed on the right side of the frame unit. Each of first and second vertical links 6 is pivotally connected to upper frame 1 and lower frame 4. Corresponding to first and second vertical links 6, there are limiting pieces 5 disposed on upper frame 1 and lower frame 4 to restrict rotation angles or directions of first and second vertical links 6.

In some embodiments, each of the first and second frame units further includes first and second side legs 21 disposed on the left and right sides of the frame unit, and at or adjacent to the distal side of the frame unit. Each of first and second side legs 21 is pivotally connected to upper frame 1 and lower frame 4 of the frame unit. Corresponding to each of first and second side legs 21, there are limiting pieces 5 disposed on upper frame 1 and lower frame 4 to restrict rotation angles or directions of first and second first and second side legs 21. In some embodiments, each of the first and second frame units further includes a lateral bar such as lateral bar 22 disposed between first and second side legs 21 and connecting the first side leg with the second side leg.

Preferably, the first and second frame units are substantially the same and symmetrical to each other. However, it should be noted that the first and second frame units are not necessarily need to be the same or symmetrical to each other. As an example, the first and second frame units can include different numbers of side legs. As another example, first and second frame units can include the same number of side legs but at different locations.

Figure 2:
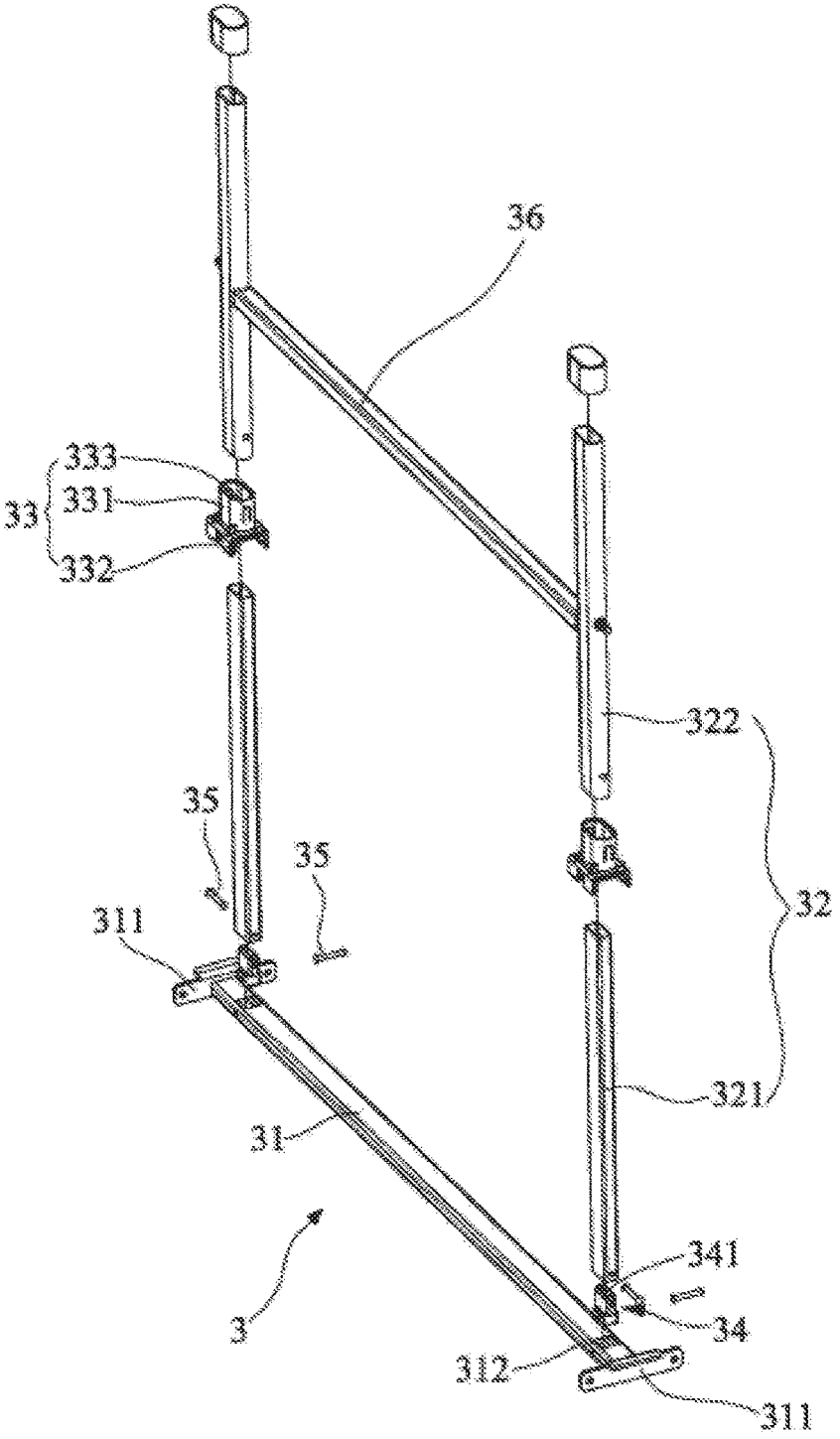
FIG. 2 is a partially disassembled view illustrating an exemplary middle leg assembly of the foldable bed frame of FIG. 1.
Figure 4:
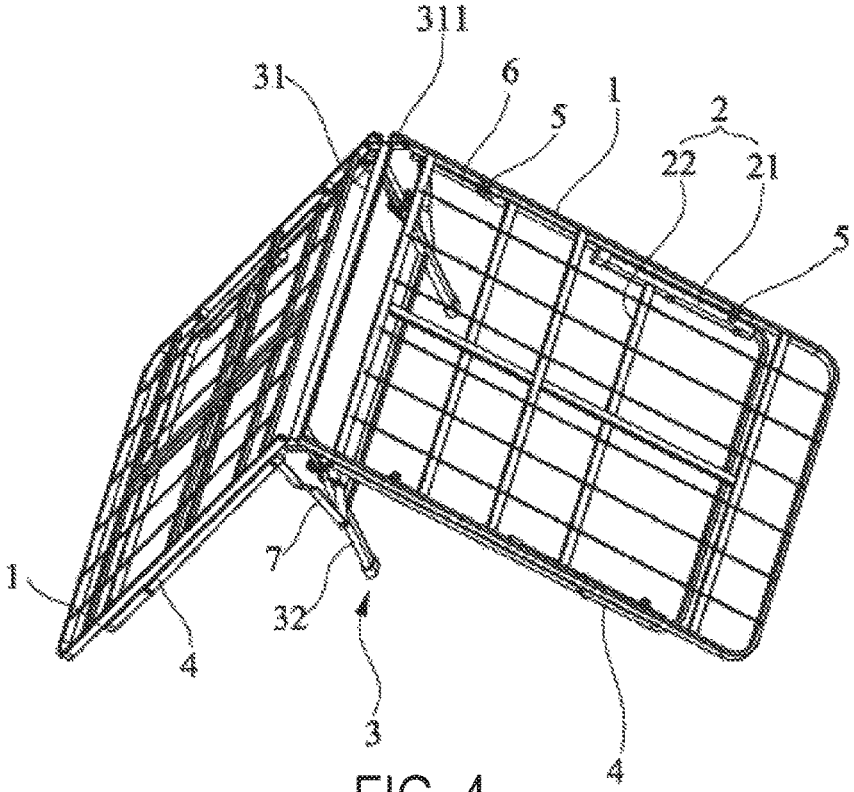
FIG. 4 illustrates the foldable bed frame of FIG. 1 in another state between folded and unfolded states.
Figure 5:
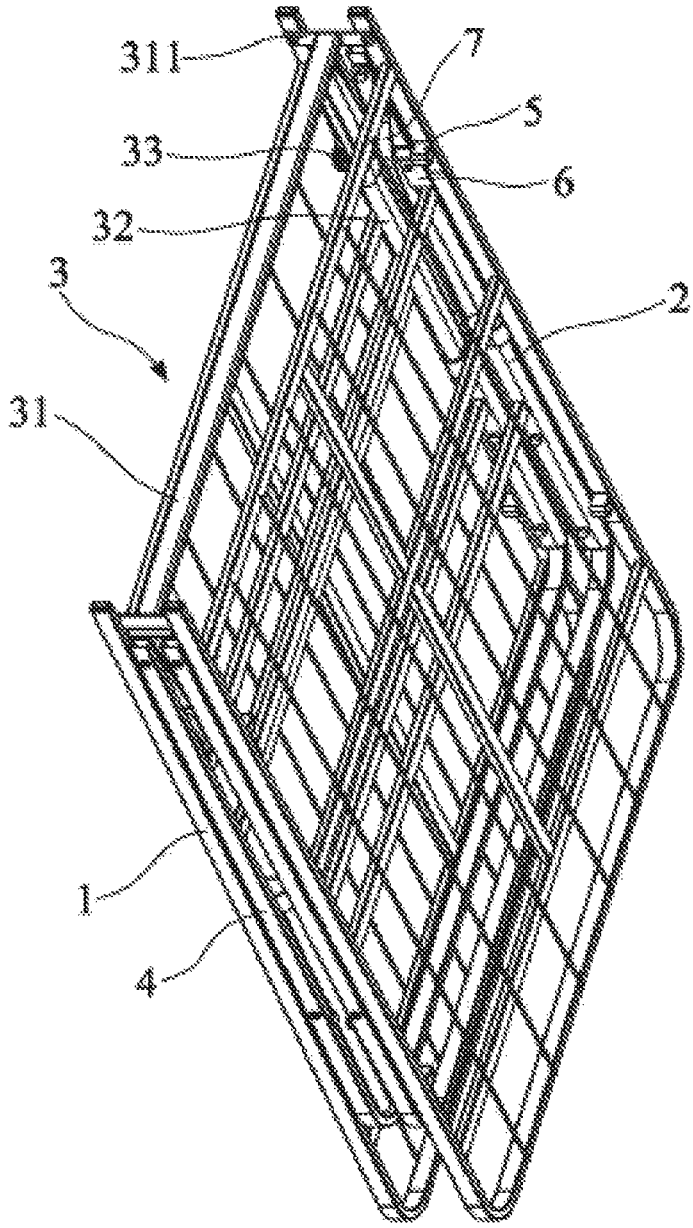
FIG. 5 illustrates the foldable bed frame of FIG. 1 in a folded state.
Figure 6:
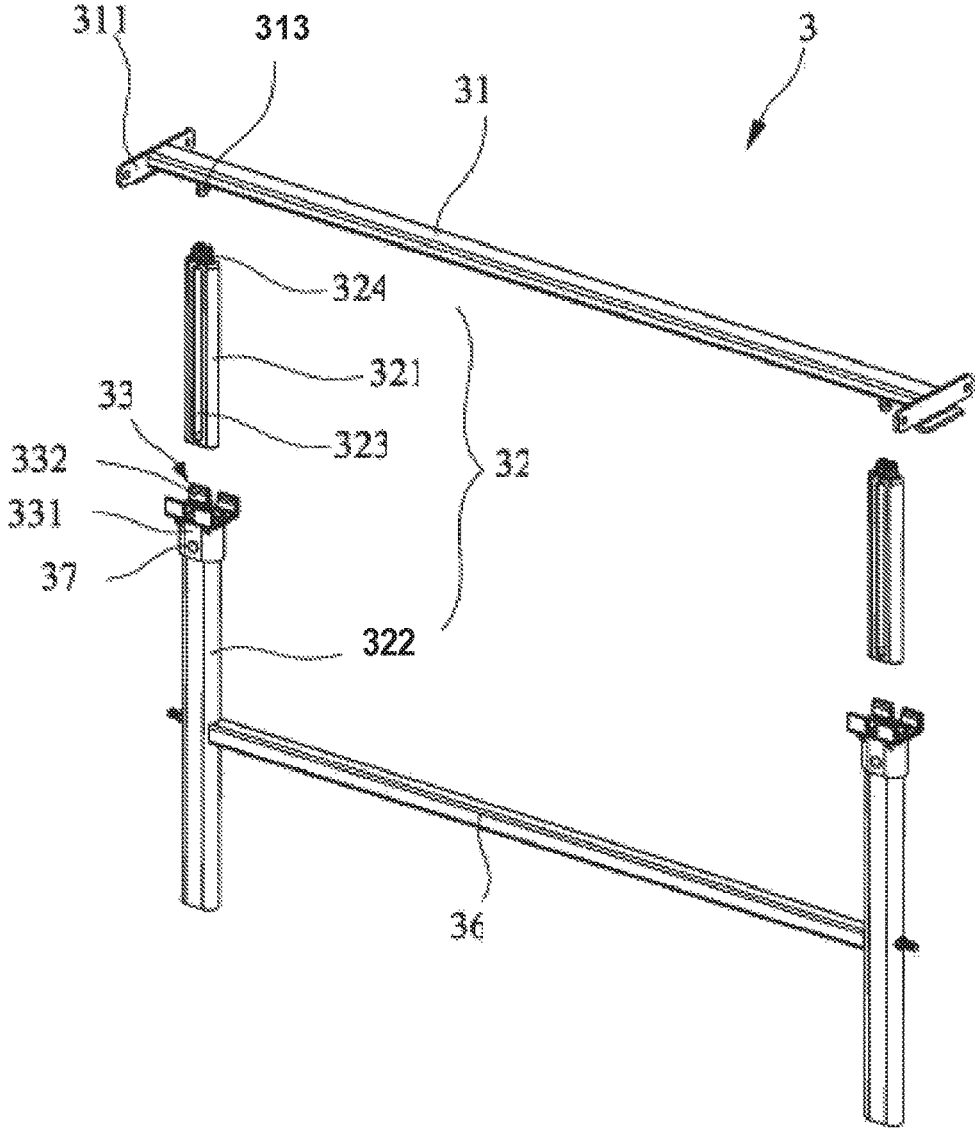
FIG. 6 is a partially disassembled view illustrating another exemplary middle leg assembly of the foldable bed frame of FIG. 1.
Figure 7:
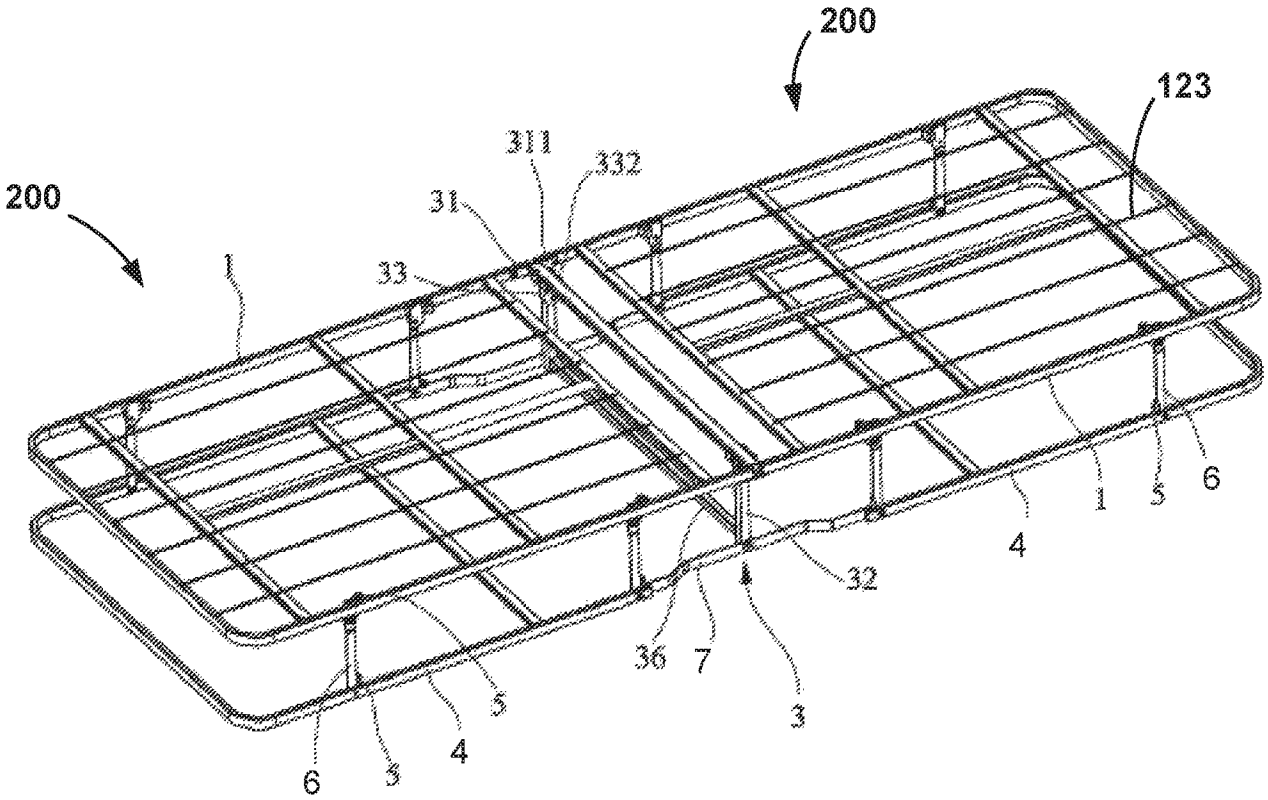
FIG. 7 is a schematic perspective view illustrating a second exemplary foldable bed frame in an unfolded state in accordance with some embodiments of the present invention.
Figure 8:
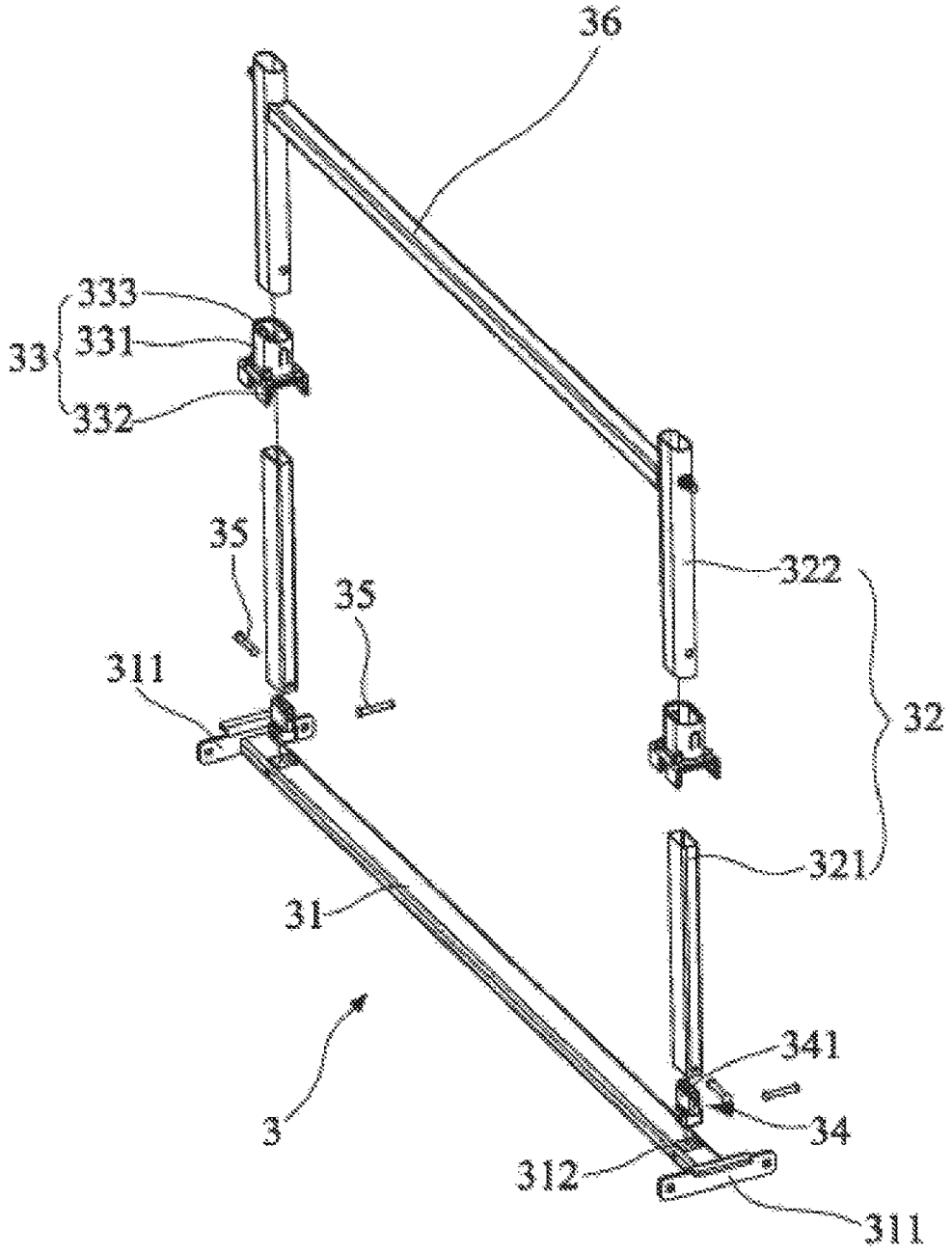
FIG. 8 is a partially disassembled view illustrating an exemplary middle leg assembly of the foldable bed frame of FIG. 7.
Figure 9:
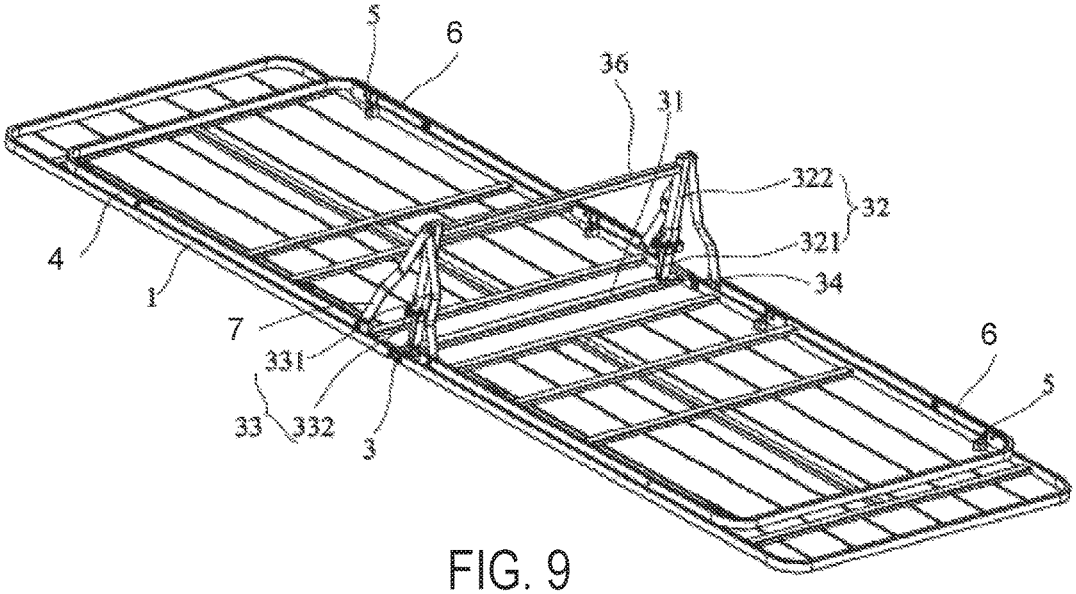
FIG. 9 illustrates the foldable bed frame of FIG. 7 in a state between folded and unfolded states.
Figure 10:
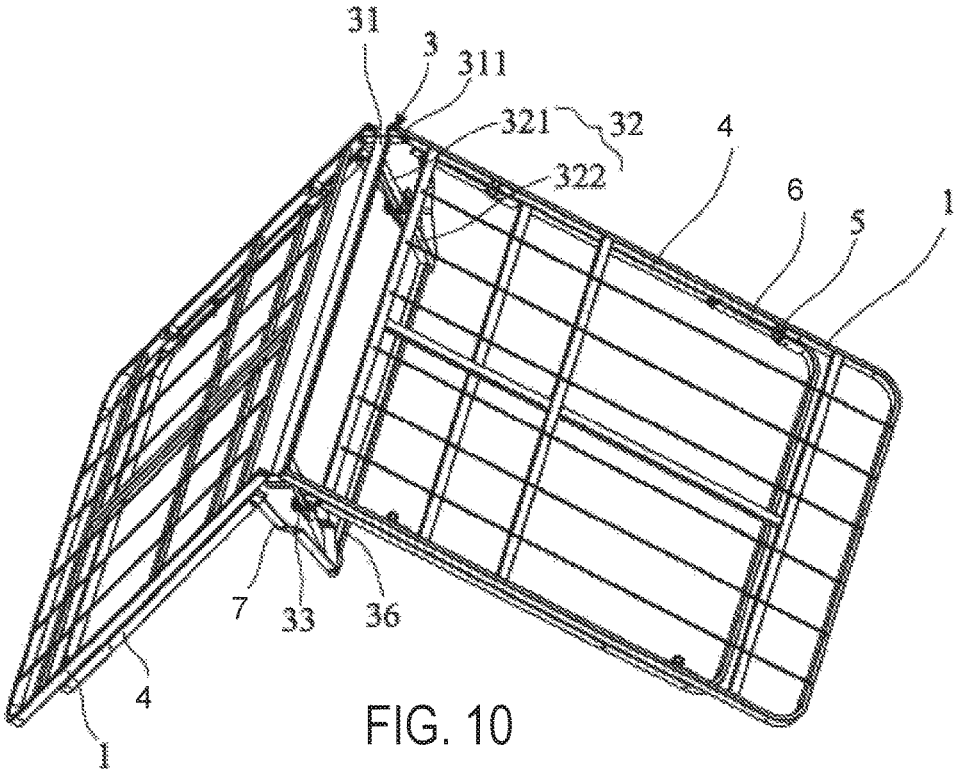
FIG. 10 illustrates the foldable bed frame of FIG. 7 in another state between folded and unfolded states.
Figure 11:
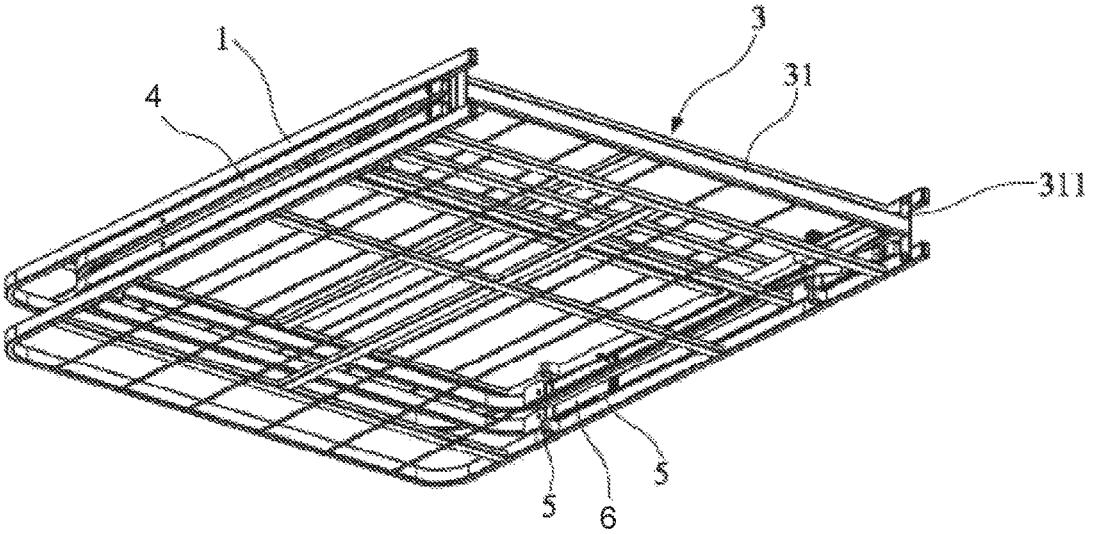
FIG. 11 illustrates the foldable bed frame of FIG. 7 in a folded state.
Figure 12:
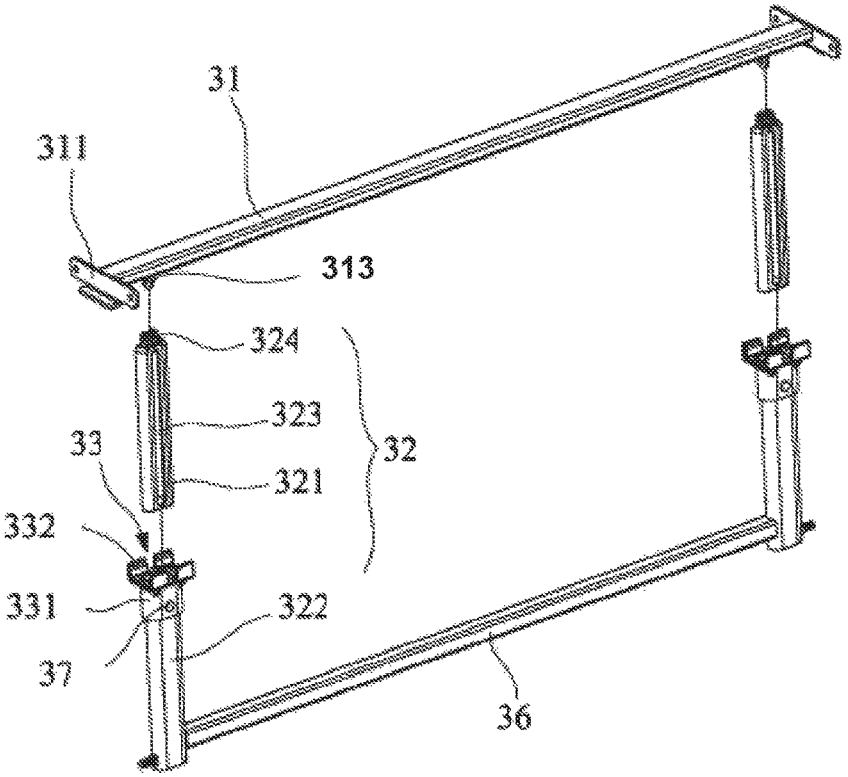
FIG. 12 is a partially disassembled view illustrating another exemplary middle leg assembly of the foldable bed frame of FIG. 7.

Continuously referring to FIGS. 1-6 and particularly to FIGS. 2 and 6, the connecting assembly, including middle leg assembly 3 and connecting pieces 7, is disposed between the first and second frame units and pivotally connected to the first and second frame units. In some embodiments, middle leg assembly 3 includes top lateral bar 31, first and second middle legs 32, and first and second pivotal links 311. Note, middle leg assembly 3 shown in FIG. 2 is up-side-down.

Top lateral bar 31 has first and second ends, at which first and second pivotal links 311 are coupled to. In some embodiments, first and second pivotal links 311 are fixedly coupled to or formed with the first and second ends of the top lateral bar. First and second pivotal links 311 are configured to pivotally connect the upper frames of the first and second frame units.

First and second middle legs 32 are coupled to top lateral bar 31 at or adjacent to the first and second ends of the top lateral bar. In a preferred embodiment, first and second middle legs 32 are coupled to a lower side of top lateral bar 31 adjacent to the first and second ends as illustrated in FIG. 2, such that when the bed frame is folded, first and second middle legs 32 are enclosed by the frame units as illustrated in FIG. 5. As a result, the folded frame is more compact.

In some embodiments, each middle leg 32 includes inner tube 321 and outer tube 322. The inner tube and the outer tube are coupled, and in some cases are slidably coupled, to each other. It should be noted that the inner tube are not necessarily hollow. It should also be noted that cross sections of the inner and outer tubes include but are not limited to square, rectangular and circular, and can be similar to or different from each other.

In some embodiments, for each of the first and second middle legs, middle leg assembly 3 further includes seat 33 or connector 34 or both. Seat 33 is disposed at an upper end of outer tube 322 and, in some cases, includes a sleeve such as sleeve 331 or the like coupled to the upper end of the outer tube. In some embodiments, seat 33 also includes a slot such as slot 332 or the like formed above the sleeve. Slot 332 is configured in accordance with the top lateral bar, such that when the inner tube is retracted into the outer tube, slot 332 holds (e.g., clamps) the top lateral bar. In some embodiments, one or more U-shaped grooves, such as U-shaped groove 333 illustrated in FIG. 6, are formed on side wall(s) of sleeve 331. In a preferred embodiment, U-shaped grooves 333 are formed on two opposite side walls of sleeve 331.

Connector 34 is configured to couple the middle leg, and preferably the inner tube of the middle leg, with the top lateral bar. In some embodiments such as those illustrated in FIG. 2, a slot such as slot 312 or the like is formed at the lower side of the top lateral bar and at each of the first and second ends of the top lateral bar to receive connector 34. In some embodiments, connector 34 includes cylindrical portion such as shaft 341 configured to be inserted into the inner tube. Connector 34 also includes fasteners such as pins 35 to fasten the connector with the top lateral bar and to fasten the inner tube with the connector.

In some embodiments, the top lateral bar and the middle legs are connected to each other through pivotal pieces disposed or formed at the top lateral bar and the middle legs. For instance, FIG. 6 illustrates pivotal piece 313 formed at the lower side of the top lateral bar and at each of the first and second ends of the top lateral bar, and a pair of pivotal pieces 324 formed at an upper end of the inner tube of each middle leg. In a preferred embodiment, pivotal piece 313 of the top lateral bar is disposed in between the pair of pivotal pieces 324 of the inner tube and connected to the pair of pivotal pieces 324.

In some embodiments, the inner tube is formed with a sliding slot and a pin is provided at the outer tube to slidably couple the inner tube and the outer tube. For example, in the embodiment illustrated in FIG. 6, inner tube 321 is formed with sliding slot 323 along a longitudinal direction of inner tube 321. Pin 37 is disposed at an upper end of outer tube 322. Pin 37 extends through sliding slot 323 of inner tube 321 and thus slidably couples inner tube 321 with outer tube 322. In some embodiments, pin 37 also extends through sleeve 331 of 33, and thus couples inner tube 321, outer tube 332 and seat 33 together.

In some embodiments, middle leg assembly 3 further includes a middle lateral bar disposed between the first and second middle legs and connecting the first middle leg with the second middle leg. For example, FIGS. 2 and 6 illustrate middle lateral bar 36 disposed between first and second middle legs 32 and connecting the first middle leg with the second middle leg.

Still referring to FIGS. 1-6, corresponding to each of the first and second middle legs, there are at least two connecting pieces 7, each having one end pivotally connected to the first or second middle leg, and the other end pivotally connected to lower frame 4 of first or second frame unit 100. In a preferred embodiment, the pivot point at which connecting piece 7 is pivotally connected to lower frame 4 of first or second frame unit 100 coincides with the pivot point at which a corresponding vertical link 6 is connected to lower frame 4. In other words, corresponding vertical link 6 and connecting piece 7 are connected to lower frame 4 at the same location. In some embodiments where the middle legs include inner and outer tubes, connecting pieces 7 are preferably connected to the outer tubes of the first and second middle legs. In some embodiments, connecting piece 7 is elongated and/or bent.

When the foldable bed frame is unfolded, connecting pieces 7 are substantially horizontal and support the proximal sides of the first and second frame units. Inner tube 321 of each middle leg 32 retracts into corresponding outer tube 322 so that slot 332 of seat 33 holds (e.g. clips or clamps) top lateral bar 31. At this state, upper frame 1 and lower frame 4 are substantially parallel to each other.

Figure 3:
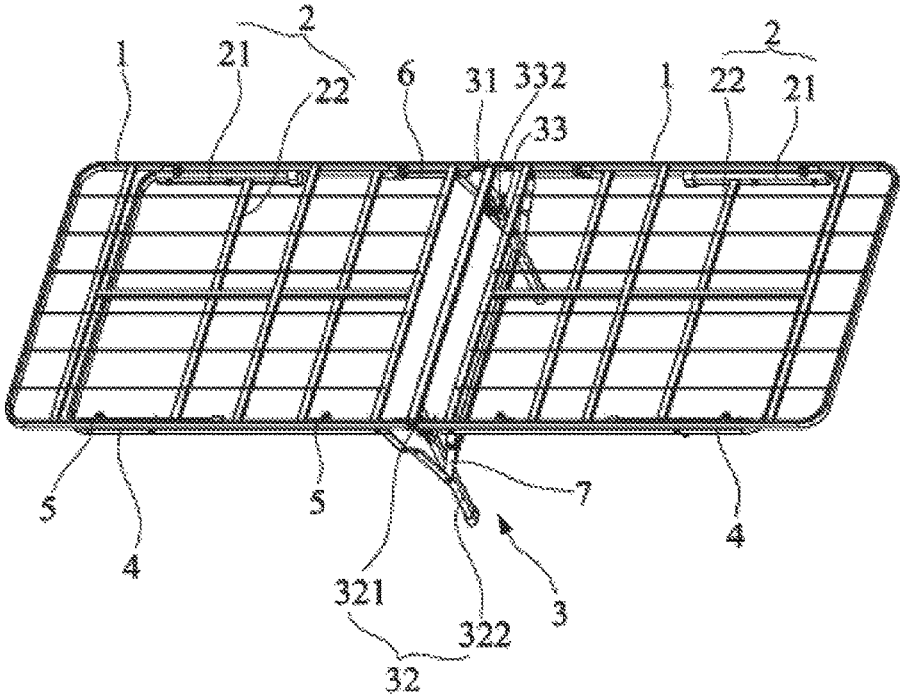
FIG. 3 illustrates the foldable bed frame of FIG. 1 in a state between folded and unfolded states.

Exemplary operations to fold the bed frame are illustrated in FIGS. 3-5. First, move lower frames 4 toward upper frames 1. This can be done, for example, by rotating lower frames 4 toward middle leg assembly 3 so that connecting pieces 7 rotates toward middle legs 32, and/or by pushing inner tubes 321 of middle legs 32 so that at least a portion of inner tube 321 extends outside of the corresponding outer tube 322. Then, rotate the first and second frame units toward middle leg assembly 3 until they coincide with each other. At this state, middle leg assembly 3 is enclosed by the first and second frame units, resulting in a compact folded bed frame.

Turning now to FIGS. 7-12, there depicts a second exemplary foldable bed frame in accordance with some embodiments of the present invention. The second exemplary foldable bed frame includes many features similar to those of the first exemplary foldable bed frame. For instance, the second exemplary foldable bed frame includes a plurality of frame units such as first and second frame units 200, a connecting assembly including a middle leg assembly such as middle leg assembly 3 and a plurality of connecting pieces such as connecting pieces 7. First and second frame units 200 are pivotally connected to each other. Each of the first and second frame units includes upper frame 1, lower frame 4, a plurality of vertical links 6 and a plurality of limiting pieces 5. Description of the similar features is omitted to avoid redundancy.

Different from the first exemplary foldable bed frame, in some embodiments, the second exemplary foldable bed frame does not include side legs 21. Instead, the second exemplary foldable bed frame includes additional vertical links that connect the upper and lower frames and support the upper frame when the bed frame is unfolded or in use. For instance, in addition to first and second vertical links 6 disposed at or adjacent to the distal side of the first or second frame unit, each frame unit 200 also includes third and fourth vertical links 6 disposed at or adjacent to the proximal side of the frame unit. Each of first, second, third, and fourth vertical links 6 is pivotally connected to upper frame 1 and lower frame 4. Corresponding to first, second, third, and fourth vertical links 6, there are limiting pieces 5 disposed on upper frame 1 and lower frame 4. The limiting pieces 5 restrict rotation angles or directions of first, second, third, and fourth vertical links 6.

Figure 14A:
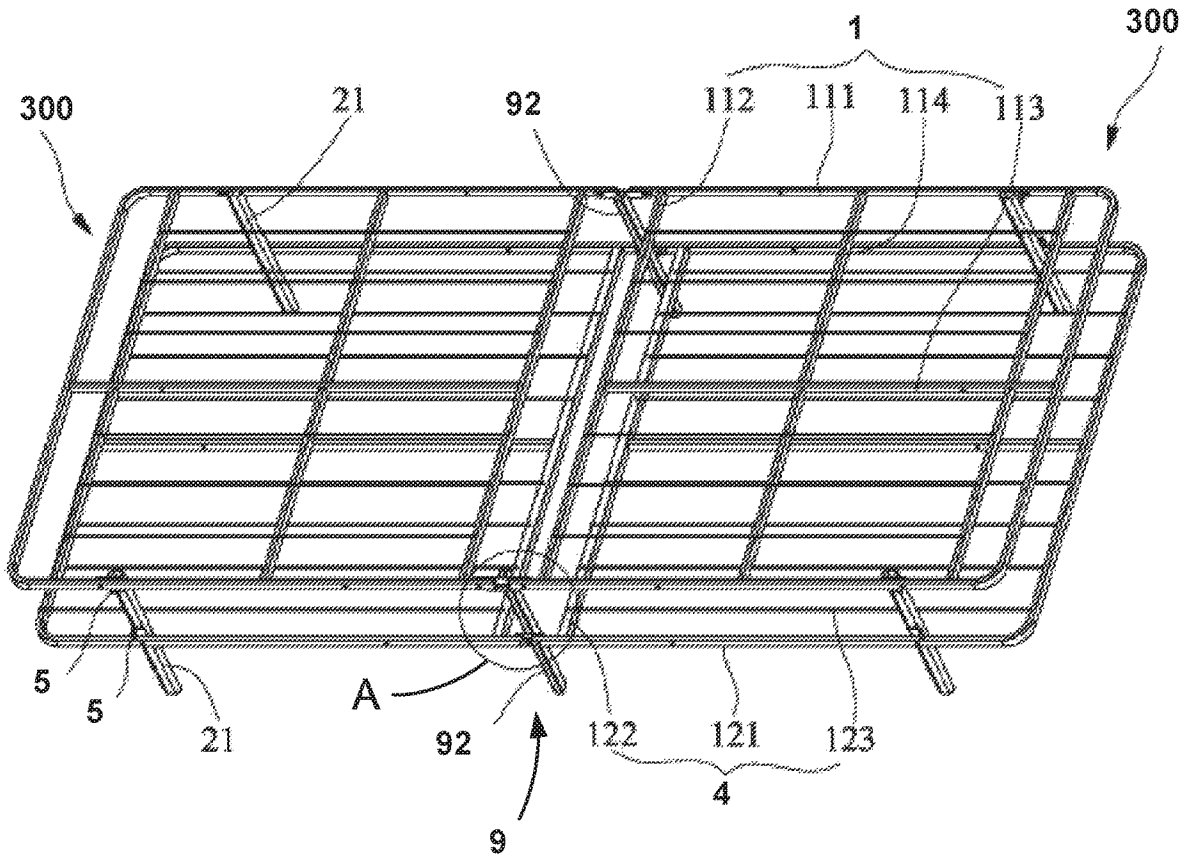
FIG. 14A is a schematic perspective view illustrating a third exemplary foldable bed frame in an unfolded state in accordance with some embodiments of the present invention.
Figure 14B:
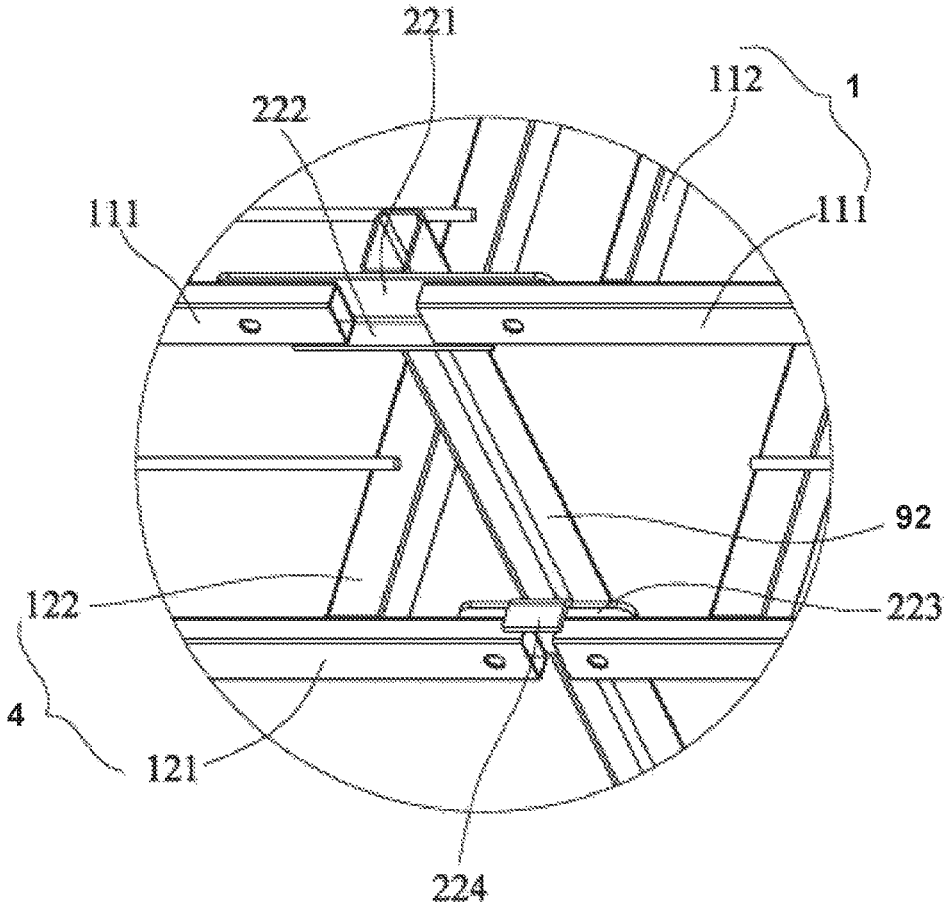
FIG. 14B is an enlarged view of FIG. 14A taken along circle A.

Referring now to FIGS. 14A and 14B, there depicts a third exemplary foldable bed frame in accordance with some embodiments of the present invention. The third exemplary foldable bed frame includes a plurality of frame units such as first and second frame units 300 and a plurality of connecting assemblies such as first and second connecting assemblies 9. First and second connecting assemblies 9 are disposed at left and right sides of the bed frame, and between first and second frame units 300. First and second frame units 300 are pivotally connected to each other at their proximal sides through first and second connecting assemblies 9.

Similar to frame units 100 of the first exemplary foldable bed frame, in some embodiments, each of first and second frame units 300 includes upper frame 1, lower frame 4, a plurality of side legs 21 and a plurality of limiting pieces 5. When the foldable bed frame is unfolded, lower frame 4 is disposed below upper frame 1. For each of the first and second frame units, the plurality of side legs includes first and second side legs 21 disposed at or adjacent to the distal side of the frame unit, with the first side leg disposed on the left side of the frame unit and the second side leg disposed on the right side of the frame unit. Each of first and second side legs 21 is pivotally connected to upper frame 1 and lower frame 4. Corresponding to first and second side legs 21, there are limiting pieces 5 disposed on upper frame 1 and lower frame 4 to restrict rotation angles or directions of first and second side legs 21. Preferably, for each side leg, the limiting piece on the upper frame and the limiting piece on the lower frame are disposed on the same side away from the connecting assembly with respect to the side leg.

In some embodiments, for each of the first and second frame units, upper frame 1 includes first and second upper longitudinal bars 111 and first and second upper lateral bars 112. First and second upper longitudinal bars 111 are disposed on left and right sides of the frame unit. First and second upper lateral bars 112 are disposed at proximal and distal sides of the frame unit and between the first and second upper longitudinal bars. Collectively, first and second upper longitudinal bars 111 and first and second upper lateral bars 112 constitute the periphery of the upper frame. Similarly, lower frame 4 includes first and second lower longitudinal bars 121 and first and second lower lateral bars 122. First and second lower longitudinal bars 121 are disposed on left and right sides of the frame unit. First and second lower lateral bars 122 are disposed at proximal and distal sides of the frame unit and between the first and second lower longitudinal bars. Collectively, first and second lower longitudinal bars 121 and first and second lower lateral bars 122 constitute the periphery of the lower frame. It should be noted that a longitudinal or lateral bar may be bent or curved. It should also be noted that a longitudinal bar may be formed monolithically with a lateral bar, for example, by bending.

In a preferred embodiment, top ends of first and second side legs 21 are pivotally connected to inner sides of the first and second upper longitudinal bars, and middle portions of first and second side legs 21 are pivotally connected to the corresponding first and second lower longitudinal bars. To limit rotation angles or directions of these side legs, the limiting pieces are disposed on lower sides of the first and second upper longitudinal bars and on upper sides of the first and second lower longitudinal bars.

In some embodiments, the upper frame of the first or second frame unit includes one or more additional upper bars, disposed longitudinally or laterally or both within the periphery of the upper frame. The additional upper bars are connected to the first and second upper lateral bars or the first and second upper longitudinal bars. In some embodiments, the additional upper bars crisscross each other. The additional upper bars enhance the support to the bedding material, such as mattress, cushion and pad, placed on the bed frame. By way of example, FIG. 14A illustrates upper longitudinal bar 113 disposed between first and second upper longitudinal bars 111 and connected to first and second upper lateral bars 112, and upper lateral bar 114 disposed between first and second upper lateral bars 112 and connected to first and second upper longitudinal bars 111. Upper longitudinal bar 113 and upper lateral bar 114 crisscross each other.

In some embodiments, each of first and second connecting assembly 9 includes a middle leg such as middle leg 92, an upper connecting piece such as upper connecting piece 221, a lower connecting piece such as lower connecting piece 223. Upper connecting piece 221 is disposed on middle leg 92, preferably at the top end of middle leg 92, and configured to pivotally connect upper longitudinal bars 111 of the first and second frame units. Lower connecting piece 223 is disposed on the middle leg, preferably at the middle portion of middle leg 92, and configured to pivotally connect lower longitudinal bars 121 of the first and second frame units. In a preferred embodiment, upper connecting piece 221 is longer than lower connecting piece 223.

In some embodiments, each of first and second connecting assemblies 9 further includes an upper stopping piece such as upper stopping piece 222, or a lower stopping piece such as lower stopping piece 224, or both. Upper stopping piece 222 is disposed or monolithically formed (e.g., by bending) at a lower side of upper connecting piece 221. When the bed frame is unfolded, upper longitudinal bars 111 of the first and second frame units are disposed above upper stopping piece 222, and pivotally connected to upper connecting piece 221. In a preferred embodiment, upper stopping piece 222 has a length shorter than a distance between pivotal points at which upper longitudinal bars 111 are connected to upper connecting piece 221, such that the pivotal points are located beyond upper stopping piece 222 in the longitudinal direction of the bed frame.

Lower stopping piece 224 is disposed or monolithically formed (e.g., by bending) at an upper side of lower connecting piece 223. When the bed frame is unfolded, lower longitudinal bars 121 of the first and second frame units are disposed below lower stopping piece 224 and pivotally connected to lower connecting piece 223. In a preferred embodiment, lower stopping piece 224 has a length shorter than a distance between pivotal points at which lower longitudinal bars 121 are connected to lower connecting piece 223, such that the pivotal points are located beyond lower connecting piece 223 in the longitudinal direction of the bed frame.

Figure 15A:
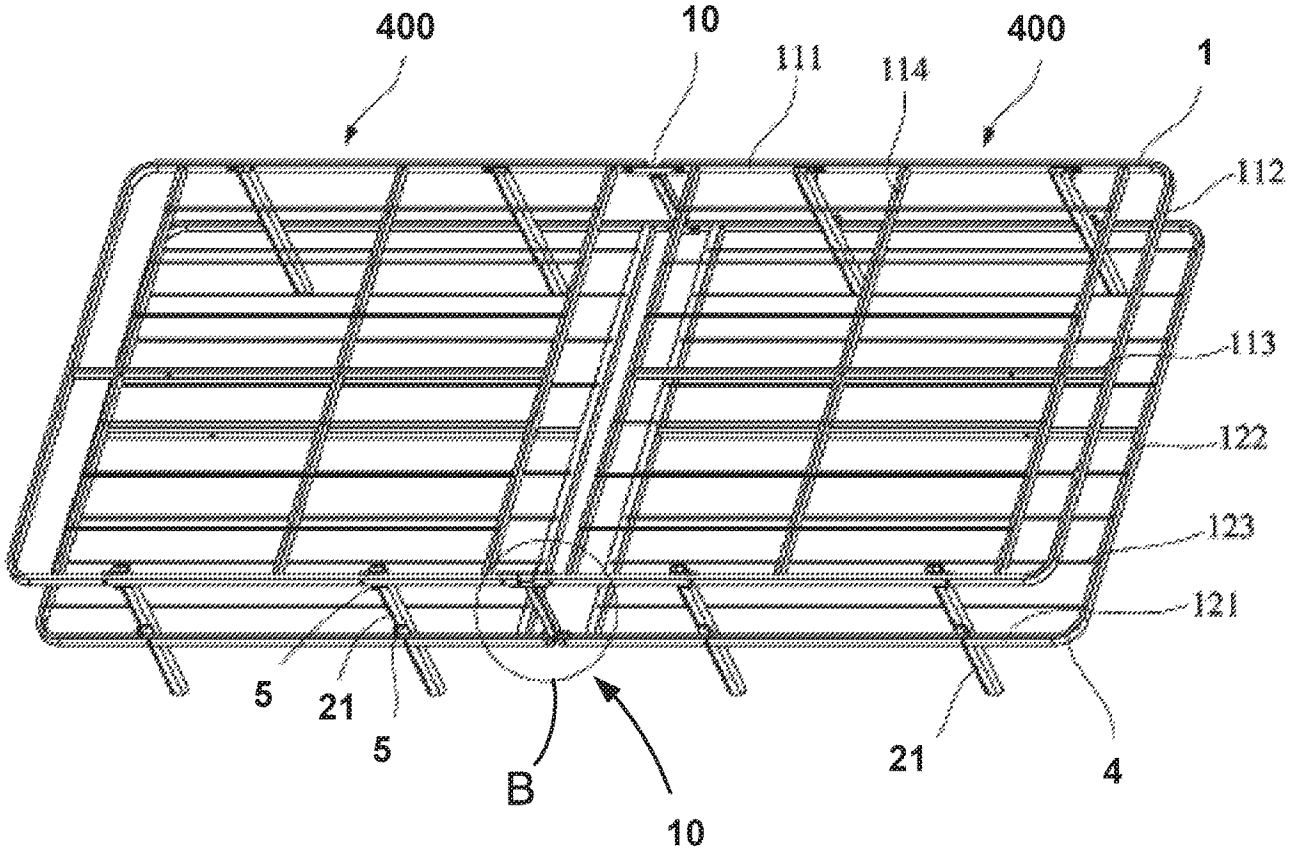
FIG. 15A is a schematic perspective view illustrating a fourth exemplary foldable bed frame in an unfolded state in accordance with some embodiments of the present invention.
Figure 15B:
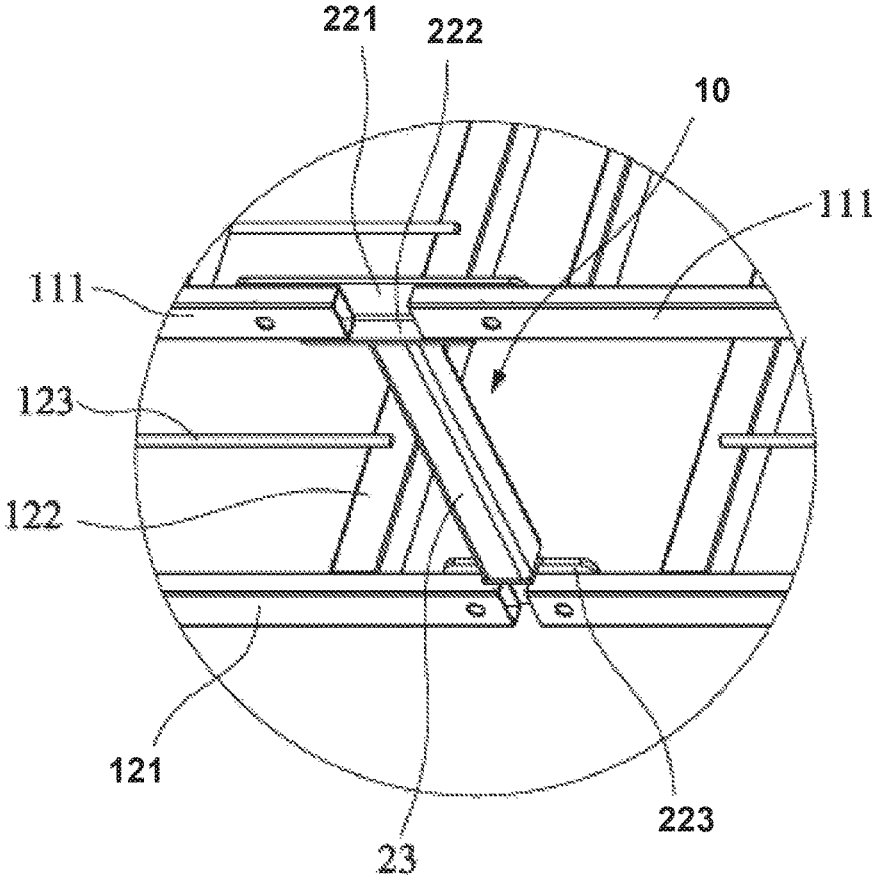
FIG. 15B is an enlarged view of FIG. 15A taken along circle B.

It should be noted that a frame unit can have more than two side legs. As an example, FIGS. 15A and 15B illustrate a fourth exemplary foldable bed frame, in which each of frame units 400 has four side legs 21, two on left side and two on right side of the frame unit. It should also be noted that a connecting assembly does not necessarily need to have a middle leg such as middle leg 32 or 92. As an example, FIGS. 15A and 15B illustrate connecting assembly 10 with a middle bar such as middle bar 23 instead of a middle leg. In such embodiments, upper connecting piece 221 is disposed on middle bar 23, preferably at the top end of middle bar 23, and configured to pivotally connect upper longitudinal bars 111 of the first and second frame units. Lower connecting piece 223 is disposed on middle bar 23, preferably at the bottom end of middle bar 23, and configured to pivotally connect lower longitudinal bars 121 of the first and second frame units. In a preferred embodiment, middle bar 23, upper connecting piece 221 and lower connecting piece 223 collectively form a substantially "工" shaped structure.

Upper stopping piece 222, lower stopping piece 224 and limiting pieces 5 allow the upper and lower frames to rotate, but when the bed frame is fully unfolded, they prevent the upper and lower frames from any further undesirable unfolding, rotating or swaying. To fold the bed frame, rotate the side legs toward the connecting assembly, push the upper and lower frames together, and then rotation first and second frame units toward the connecting assembly until they coincide with each other.

Figure 13:
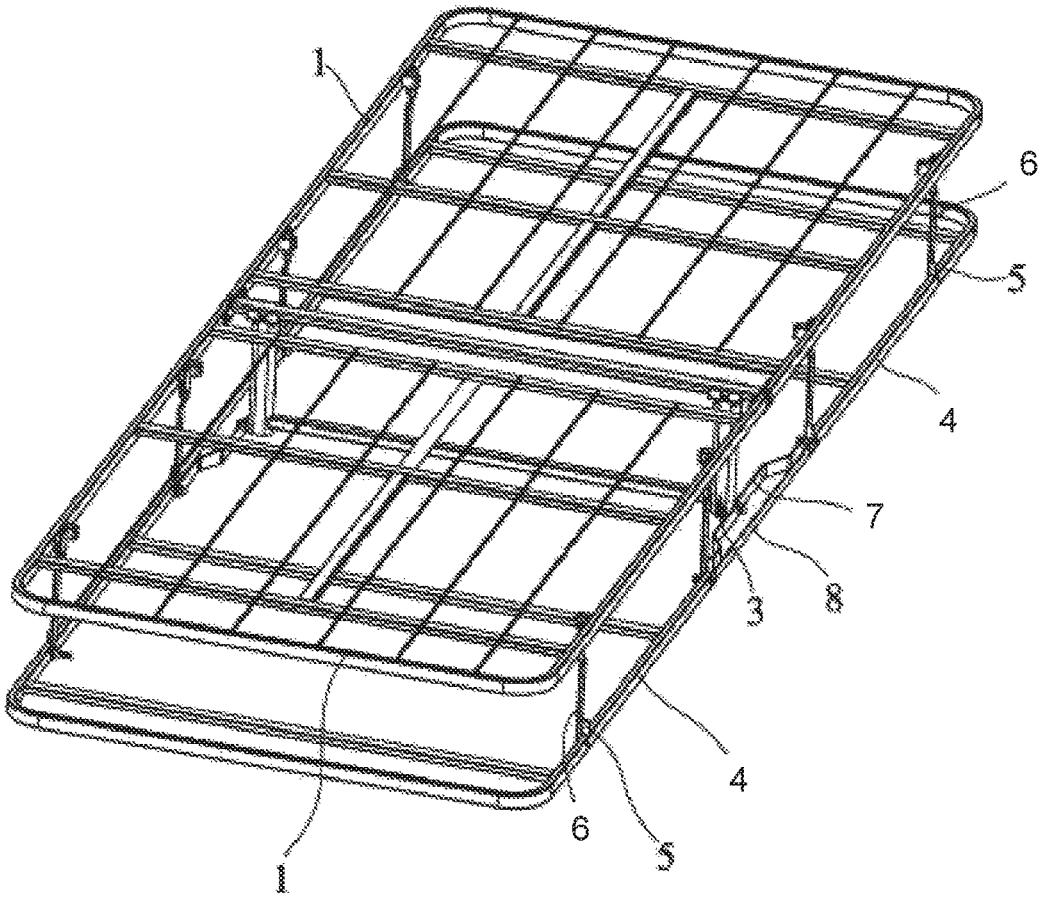
FIG. 13 is a schematic perspective view illustrating the foldable bed frame of FIG. 7 with alternative, additional or optional features.

A foldable bed frame of the present invention can include alternative, additional or optional features. As an example, FIG. 13 illustrates the second exemplary foldable bed frame including elastic members such as first and second elastic ropes 8. First and second elastic ropes 8 connect the corresponding proximal sides of the lower frames of the first and second frame units. They do not affect folding or unfolding of the bed frame. They are tightened when the bed frame is unfolded, and are loose when the bed frame is folded. They help in maintaining bed skirts smooth and flat, and thus enhance the aesthetic appearance in particular for bed frames having middle legs disposed inside of the outer peripheries of the frame units, seats on the outer tubes, bent connecting pieces, or the like.

As another example, FIGS. 1-13 illustrate upper frame 1 including a plurality of beams or rods 123 or the like and FIGS. 14A-15B illustrate lower frame 4 including a plurality of beams or rods 123. Beams or rods 123 can be disposed longitudinally and connected to lateral bars 112 and 122, or disposed laterally and connected to longitudinal bars 111 and 121. Beams or rods 123 can also be disposed in any suitable directions, for instance, some disposed longitudinally and some laterally and crisscrossing each other.

Bed frames of the present invention have several advantages. For example, when a bed frame of the present invention is unfolded, the upper and lower frames create compartment(s) between the upper and lower frames. The compartment(s) can be used, for example as storage(s) for household items, effectively increasing the usage and capacity of the space underneath the bed frame. The lower frames also facilitate positioning and holding of a bed skirt/sheet. With the presence of the lower frames, the edges of the bed skirt/sheet are smooth and flat, enhancing the aesthetic appearance of the bed. In addition, side and/or middle legs support the lower frames above the ground or the floor, making it easy and convenient to clean the ground/floor underneath the bed frame. As such, dust or the like can be prevented from accumulation underneath the bed frame.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "upper" or "lower", "left" or "right", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first frame unit could be termed a second frame unit, and, similarly, a second frame unit could be termed a first frame unit, without changing the meaning of the description, so long as all occurrences of the "first frame unit" are renamed consistently and all occurrences of the "second frame unit" are renamed consistently.

What is claimed is:

1. A foldable bed frame, comprising:

a first frame unit and a second frame unit pivotally connected to each other at proximal sides thereof, wherein each frame unit comprises:

an upper frame;

a lower frame disposed below the upper frame when the foldable bed frame is unfolded;

a plurality of vertical links comprising first and second vertical links disposed on left and right sides of the frame unit, and at or adjacent to the proximal side of the frame unit, wherein each of the first and second vertical links is pivotally connected to the upper and lower frames; and a plurality of limiting pieces disposed on the upper frame and the lower frame to limit rotation angles or directions of the vertical links; and a connecting assembly disposed between the first and second frame units and pivotally connected to the first frame unit and the second frame unit, the connecting assembly comprising a middle leg assembly and a plurality of connecting pieces, wherein the middle leg assembly comprises:

a top lateral bar having first and second ends;

first and second middle legs coupled to the first and second ends of the top lateral bar at a lower side of the top lateral bar, wherein each middle leg comprises an inner tube and an outer tube slidably coupled to each other; and first and second pivotal links coupled to the first and second ends of the top lateral bar and pivotally connected to the upper frames of the first and second frame units; and wherein each of the connecting pieces has one end pivotally connected to the first or second middle leg, and the other end pivotally connected to the lower frame of the first or second frame unit at a location where a corresponding vertical link is connected to the lower frame.

2. The foldable bed frame of claim 1, wherein the first frame unit is substantially symmetric to the second frame unit.

3. The foldable bed frame of claim 1, wherein for each of the first and second middle legs, the middle leg assembly further comprises one or more of the following:

a seat disposed at an upper end of the outer tube, the seat comprising a sleeve coupled to the upper end of the outer tube and a clamping slot formed above the sleeve and corresponding to the top lateral bar; and a connector coupled to the top lateral bar, and connecting the inner tube with the top lateral bar.

4. The foldable bed frame of claim 3, wherein the sleeve is formed with U-shaped grooves on opposite side walls.

5. The foldable bed frame of claim 3, wherein:

the lower side of the top lateral bar is formed with a slot adjacent to each of the first and second ends of the top lateral bar to receive the connector; and the connector comprises a shaft inserted into the inner tube of the middle leg and fasteners to affix the connector with the top lateral bar and affix the inner tube with the connector.

6. The foldable bed frame of claim 1, wherein the inner and outer tubes of each middle leg are slidably coupled to each other by a sliding slot formed on the inner tube along a longitudinal direction of the inner tube, and a pin disposed at an upper end of the outer tube and extended through the sliding slot of the inner tube.

7. The foldable bed frame of claim 1, wherein for each of the first and second middle legs:

the middle leg assembly further comprises a seat disposed at an upper end of the outer tube, the seat comprising a sleeve coupled to the upper end of the outer tube and a clamping slot formed above the sleeve and corresponding to the top lateral bar; and the seat, the inner tube and the outer tube are coupled to each other by a sliding slot formed on the inner tube along a longitudinal direction of the inner tube, and a pin disposed at the upper end of the outer tube, wherein the pin extends through the sliding slot of the inner tube and the sleeve of the seat.

8. The foldable bed frame of claim 1, wherein for each of the first and second middle legs:

the lower side of the top lateral bar is provided or formed with a pivotal piece at each of the first and second ends of the top lateral bar; and an upper end of the inner tube is provided or formed with a pair of pivotal pieces, wherein the pivotal piece of the top lateral bar is disposed between the pair of pivotal pieces of the inner tube and connected thereto.

9. The foldable bed frame of claim 1, wherein the middle leg assembly further comprises a middle lateral bar connecting the first and second middle legs.

10. The foldable bed frame of claim 1, wherein the one end of each connecting piece is pivotally connected to the outer tube of the first or second middle leg.

11. The foldable bed frame of claim 1, wherein:

each of the first and second frame units further comprises first and second side legs disposed on the left and right sides of the first or second frame unit, and at or adjacent to a distal side of the first or second frame unit, wherein each of the first and second side legs is pivotally connected to the upper and lower frames of the first or second frame unit; and the plurality of limiting pieces comprises limiting pieces disposed on the upper and lower frames to limit rotation angles or directions of the first and second side legs.

12. The foldable bed frame of claim 11, wherein each of the first and second frame units further comprises a middle lateral bar disposed between the first and second side legs and connecting the first side leg with the second side leg.

* * * * *